US007148855B1

(12) United States Patent
Homer et al.

(10) Patent No.: US 7,148,855 B1
(45) Date of Patent: Dec. 12, 2006

(54) CONCAVE TAPERED SLOT ANTENNA

(75) Inventors: Robert S. Homer, San Diego, CA (US); Robbi Mangra, San Diego, CA (US); Hale B. Simonds, Santee, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 125 days.

(21) Appl. No.: 10/932,646

(22) Filed: Aug. 31, 2004

(51) Int. Cl.
*H01Q 13/10* (2006.01)

(52) U.S. Cl. ..... 343/767; 343/768

(58) Field of Classification Search ..... 343/700 MS, 343/767, 770, 768, 786, 840
See application file for complete search history.

(56) References Cited

U.S. PATENT DOCUMENTS 5,117,240 A * 5/1992 Anderson et al. ..... 343/786
6,075,493 A * 6/2000 Sugawara et al. ..... 343/767
6,097,348 A * 8/2000 Chen et al. ..... 343/840

OTHER PUBLICATIONS

N. Michishita and H. Arai, FDTD Analysis of Printed Monopole Antenna, 11th International Conf of Antennas and Propagation, Apr. 17-20, 2001, Conf Publication No. 480, IEE 2001, pp. 728-731.
D. H. Schaubert, et al. Moment Method Analysis of Infinite Stripline-Fed Tapered Slot Antenna Arrays w. a Ground Plane, IEEE Transactions on Antennas & Propagation, vol. 42, No. 8 Aug. 1994, pp. 1161-1166.

* cited by examiner

*Primary Examiner*—Tuyet Vo
*Assistant Examiner*—Jimmy Vu
(74) *Attorney, Agent, or Firm*—Allan Y. Lee; Michael A. Kagan; Peter A. Lipovsky

(57) ABSTRACT

A concave tapered slot antenna. The antenna includes a first antenna element, a second antenna element and a concave dielectric lens. The first and second antenna elements are situated in a tapered slot antenna configuration. The concave dielectric lens is situated between said first and second antenna elements so that a 3 dB beamwidth for selected frequencies is increased. A method for fabricating concave tapered slot antennas is also described.

17 Claims, 12 Drawing Sheets

Side View

530

Side View

CONCAVE TAPERED SLOT ANTENNA

CROSS-REFERENCE TO RELATED APPLICATIONS

This application is related to U.S. patent application No.: Unknown, filed herewith, entitled "Improved Tapered Slot Antenna", by Rob Horner et al., Navy Case No. 96507, which is hereby incorporated by reference in its entirety herein for its teachings on antennas.

BACKGROUND OF THE INVENTION

The present invention is generally in the field of antennas.

Typical tapered slot antennas (TSAs) are broad band (BB) antennas having high gain and directive characteristics at upper frequency ranges, and reduced gain and omni directional characteristics at lower frequency ranges. At higher frequencies, typical TSAs have directive beamwidth patterns corresponding to narrow half power (−3 dB) beamwidths.

TSA arrays require individual TSAs to overlap beamwidths to provide complete coverage. Thus, typical TSA arrays require an increased number of typical TSAs due to the relatively narrow 3 dB beamwidth of individual typical TSAs at higher frequencies, which can increase the array weight.

A need exists for concave TSAs having increased horizontal and vertical 3 dB beamwidths at higher frequencies, increased gain and increased bandwidth.

DETAILED DESCRIPTION OF THE INVENTION

The present invention is directed to Concave Tapered Slot Antennas. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention that use the principles of the present invention are not specifically described in the present application and are not specifically illustrated by the present drawings.

DEFINITIONS

The following definitions and acronyms are used herein:

Acronym(s):

TSA—Tapered Slot Antenna

BB—Broad Band

CTSA—Concave Tapered Slot Antenna

AE—Antenna Element

CDL—Concave Dielectric Lens

SIB—Semi-Infinite Balun rf—radio frequency

I/O—Input/Output

Definition(s):

Concave—curved like the interior or a circle, sphere or ellipsoid.

Beamwidth—the angular width of an antenna lobe or radiated power of an antenna

Half power beamwidth—beamwidth at its half power point, which corresponds to the minus 3 dB point when plotted on an ordinate scale in decibels.

3 dB beamwidth—same as half power beamwidth.

The concave TSA (CTSA) includes a first antenna element (AE), a second AE and a concave dielectric lens (CDL). The CTSA can operate with a CDL having one of a plurality of configurations without departing from the scope or spirit of the invention. In one embodiment, the CTSA increases 3 dB beamwidths. In one embodiment, the CTSA increases horizontal 3 dB beamwidths. In one embodiment, the CTSA increases horizontal 3 dB beamwidths at higher frequencies. In one embodiment, the CTSA increases vertical 3 dB beamwidths. In one embodiment, the CTSA increases both horizontal and vertical 3 dB beamwidths. In one embodiment, the CTSA operates over a large bandwidth. In one embodiment, the CTSA has increased gain.

Figure 1A:
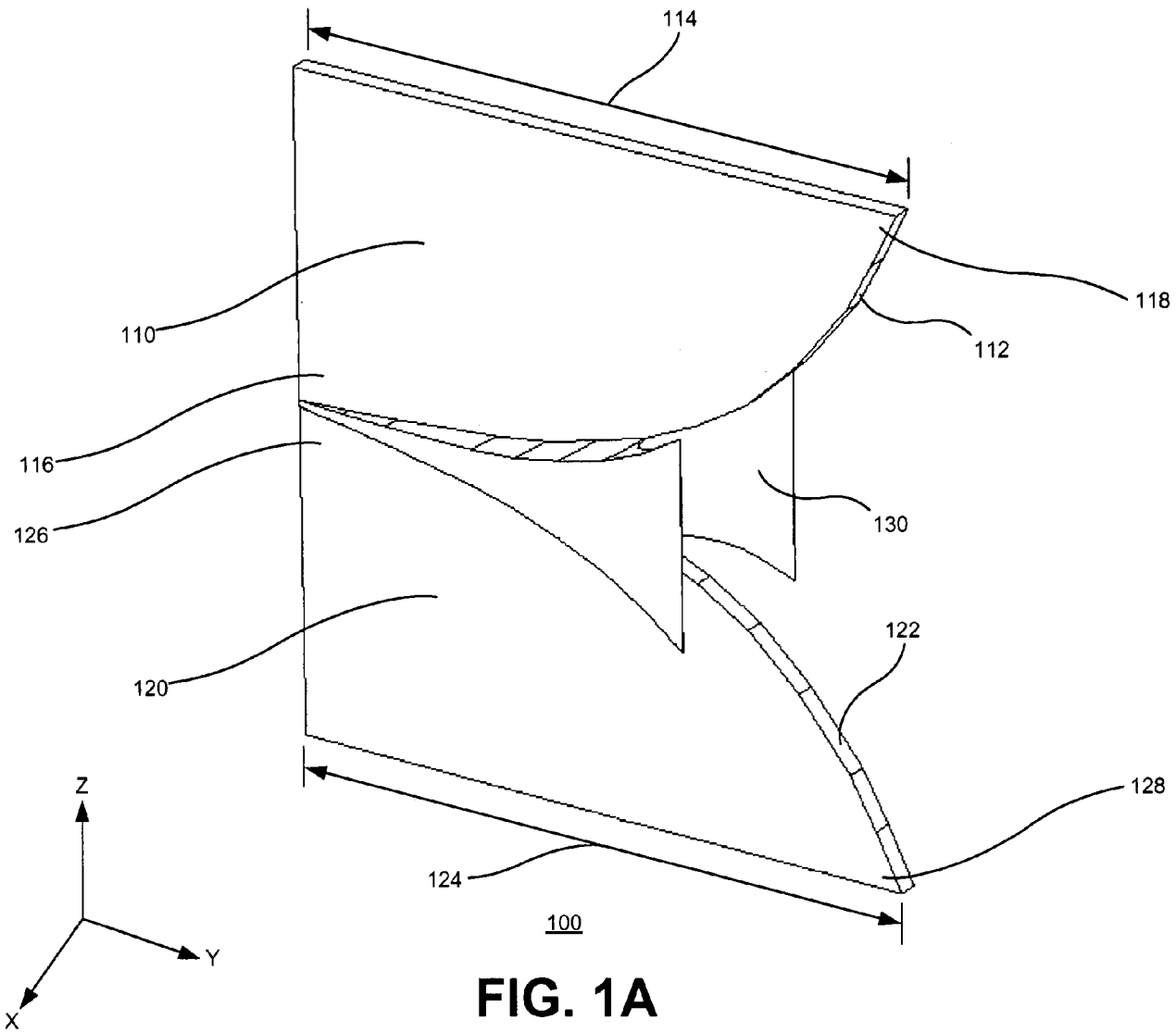
FIG. 1A is a perspective view of one embodiment of a CTSA.

FIG. 1A is a perspective view of one embodiment of a CTSA. As shown in FIG. 1A, CTSA 100 includes first AE 110, second AE 120 and CDL 130. First AE 110 and second AE 120 are situated in a TSA configuration. First and second antenna elements 110, 120 comprise a substantially conductive material such as, for example, stainless steel and aluminum. First and second antenna elements 110, 120 are capable of transmitting and receiving radio frequency (rf) energy. First and second AE 110, 120 have feed ends 116, 126, respectively, and launch ends 118, 128, respectively. Feed ends 116, 126 can be operatively coupled to an input/output (I/O) feed such as a coaxial cable. The I/O feed can be used to transmit and receive rf signals to and from CTSA 100. Rf signals can be transmitted from the feed ends 116, 126 toward the launch ends 118, 128, whereas, the rf signals launch from the antenna at a point between these ends depending upon the signal frequency. Rf signals having higher frequencies launch closer to feed ends 116, 126 and rf signals having lower frequencies launch closer to launch ends 118, 128.

As shown in FIG. 1A, First and second AE 110, 120 have curvature 112 and curvature 122, respectively. In one embodiment, curvatures 112 and 122 can each be represented by the following Equation 1:

$$Y(x)=a(e^{bx}-1); \quad \text{(Equation 1)}$$

where, a and b are parameters selected to produce a desired curvature. In one embodiment, parameters "a" and "b" are approximately equal to 0.2801 and 0.1028, respectively. First and second AE 110, 120 have length 114 and length 124, respectively. In one embodiment, length 114 and length 124 are approximately equal.

Figure 1B:
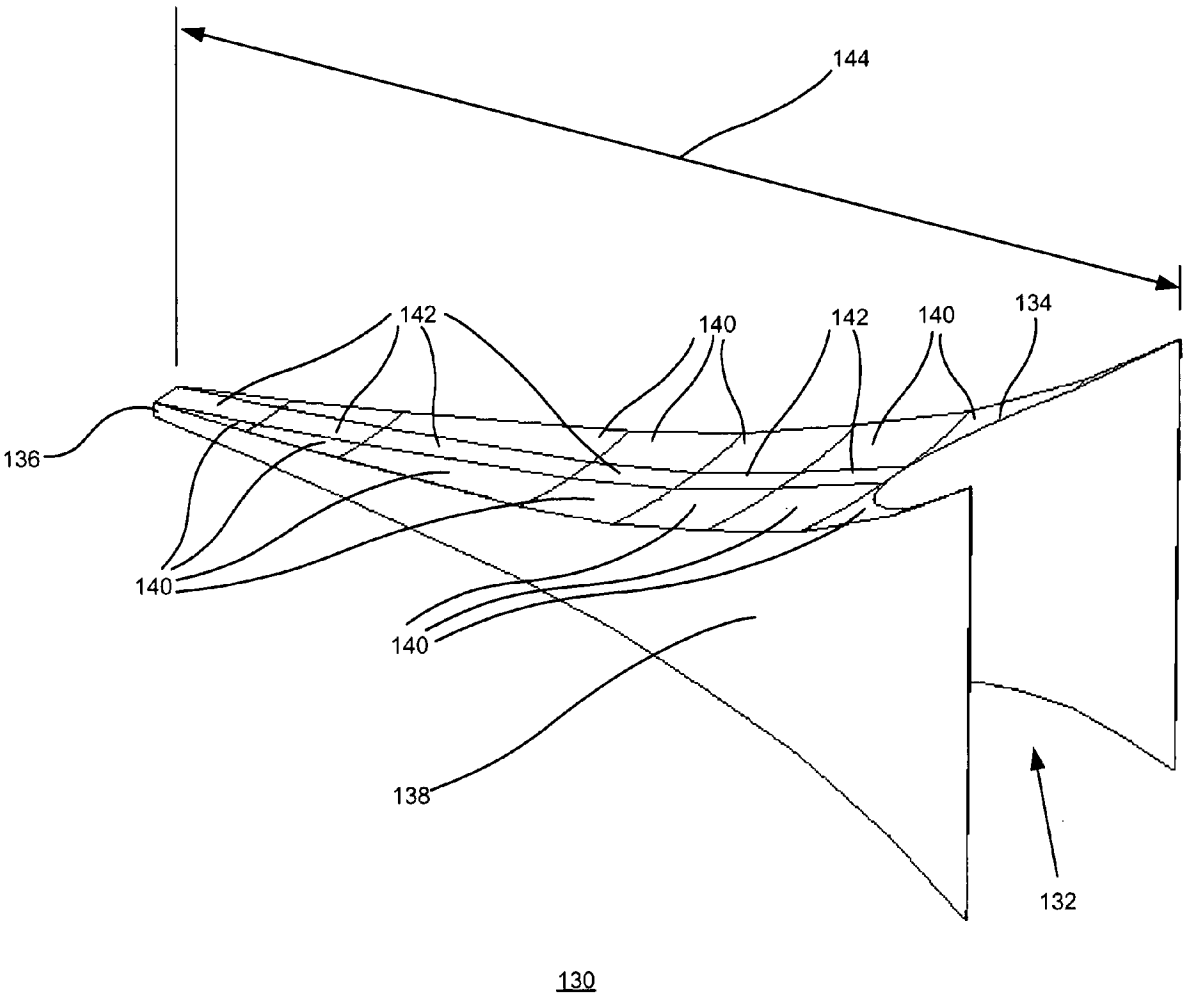
FIG. 1B is a perspective view of one embodiment of a component of a CTSA.
Figure 1C:
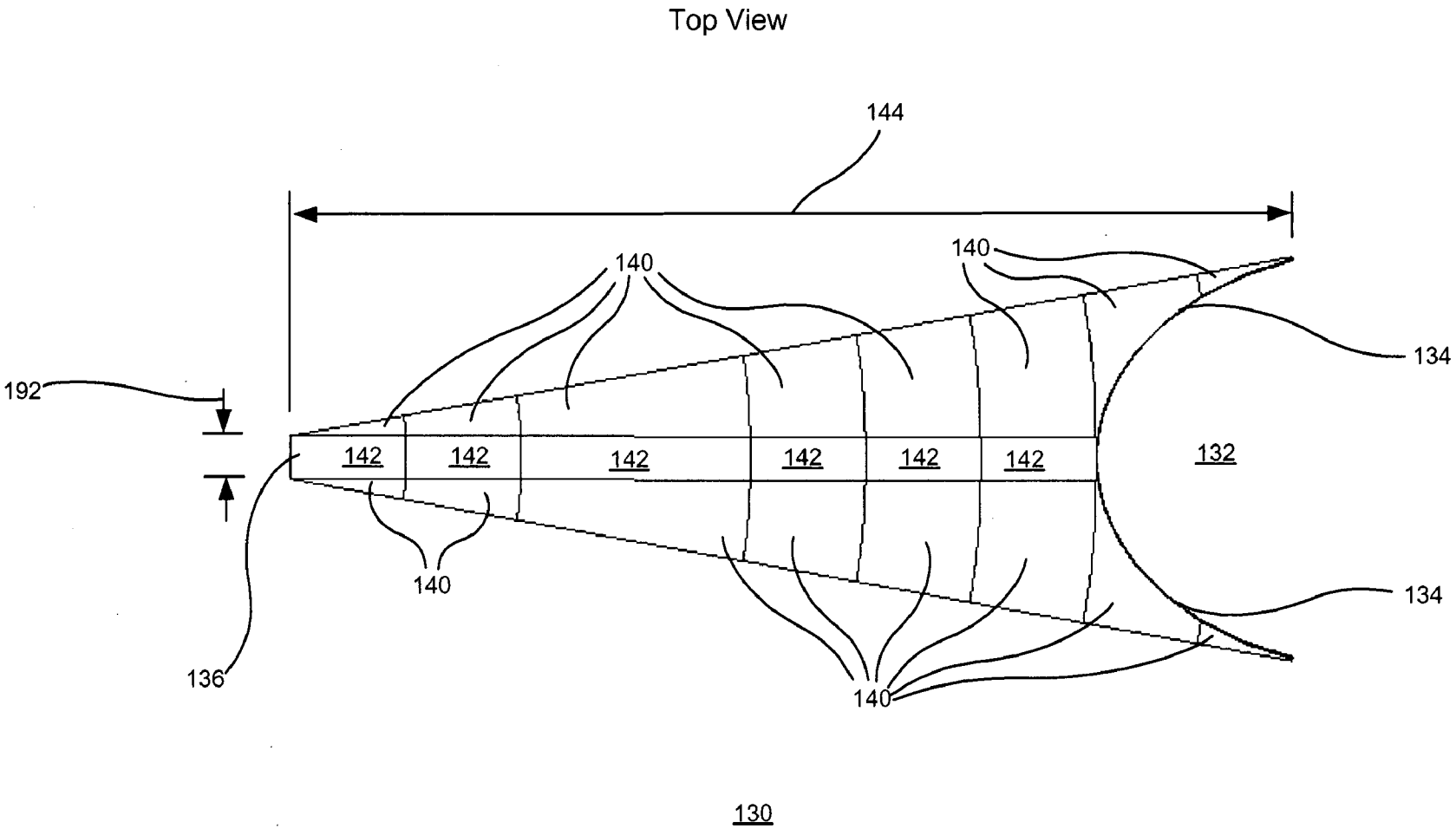
FIG. 1C is a top view of one embodiment of a component of a CTSA.

CDL 130 is now described with reference to FIGS. 1A–1C. FIG. 1B is a perspective view of one embodiment of CDL 130 of CTSA 100. FIG. 1C is a top view of one embodiment of CDL 130 of CTSA 100. CDL 130 comprises a dielectric material and has length 144. Concave curvature 134 of CDL 130 helps define concave aperture 132. Concave curvature 134 can comprise various concave shapes such as, for example, circular, spherical and ellipsoid. In one embodiment, concave curvature 134 comprises a circular shape with respect to a vertical axis, which increases horizontal 3 dB beamwidth. In one embodiment, concave curvature 134 comprises a circular shape with respect to a horizontal axis, which increases vertical 3 dB beamwidth. For reference, the Z-axis is a vertical axis and the X-axis and Y-axis are horizontal axis (see FIG. 1A). In one embodiment, concave curvature 134 comprises a spherical shape, which increases horizontal and vertical 3 dB beamwidth. In one embodiment, concave curvature 134 comprises an ellipsoid shape, which increases horizontal and vertical 3 dB beamwidth.

Feed end 136 is situated proximate to feed ends 116, 126 and has width 192. In one embodiment, width 192 (FIG. 1C) is approximately equal to a gap width of CTSA 100. Side surface 138 can comprise shapes such as rectangular, trapezoidal and curvilinear trapezoidal. Side surface 138 can be generally planar or curvilinear. In one embodiment, side surface 138 is generally planar having a top and bottom curvature that is substantially similar to curvatures 112, 122.

Inner top surface 142 extends from feed end 136 to concave curvature 134. Inner top surface 142 has a curvature with regard to a side view that is substantially similar to curvature 112. Inner top surface 142 is adapted to be situated below first AE 110 along curvature 112. In one embodiment, inner top surface 142 is substantially flush to curvature 112 of first AE 110. CDL 130 also includes an inner bottom surface (not shown in FIGURES), which is substantially similar to inner top surface 142. The inner bottom surface is adapted to be situated above second AE 120 along curvature 122. In one embodiment, the inner bottom surface is substantially flush to curvature 122 of second AE 120. Outer top surface 140 is substantially bounded by inner top surface 142, feed end 136 and concave curvature 134. Outer top surface 140 can comprise different curvatures than inner top surface 142. In one embodiment, outer top surface can be adapted to extend next to first AE 110 as described below with reference to FIG. 5. CDL 130 also includes an outer bottom surface (not shown in FIGURES), which is substantially similar to outer top surface 140 and can be adapted to extend next to second AE 120 as described below with reference to FIG. 5. In one embodiment, CDL 130 has an extremely small outer top surface 140 and outer bottom surface. In one embodiment, CDL 130 does not have an outer top surface 140 or outer bottom surface.

CDL 130 is capable of increasing 3 dB beamwidth of CTSA 100. The 3 dB beamwidth increase (horizontal, vertical and frequencies effected) depends on concave aperture 132 and length 144 of CDL 130. In the embodiment of FIG. 1A, concave aperture 132 comprises a circular shape with respect to a vertical axis, which increases horizontal 3 dB beamwidths. For reference, a horizontal plane is parallel to an X-Y plane (see FIG. 1A). In addition, specified rf signal frequencies have increased 3 dB beamwidths depending on length 144 relative to lengths 114 and 124. Rf signals having frequencies that launch from first and second AE 110, 120 prior to horizontally passing concave aperture 132 (i.e., higher frequencies) gain an increase in horizontal 3 dB beamwidth (i.e., become broader). In addition, rf signals having frequencies that launch from first and second AE 110, 120 after horizontally passing concave aperture 134 (i.e., lower frequencies) are largely unaffected by CDL 130, and thus, do not gain an increase in horizontal 3 dB beamwidth. Concave aperture 132 can be configured in various concave shapes for desired effects on 3 dB beamwidth.

Figure 2:
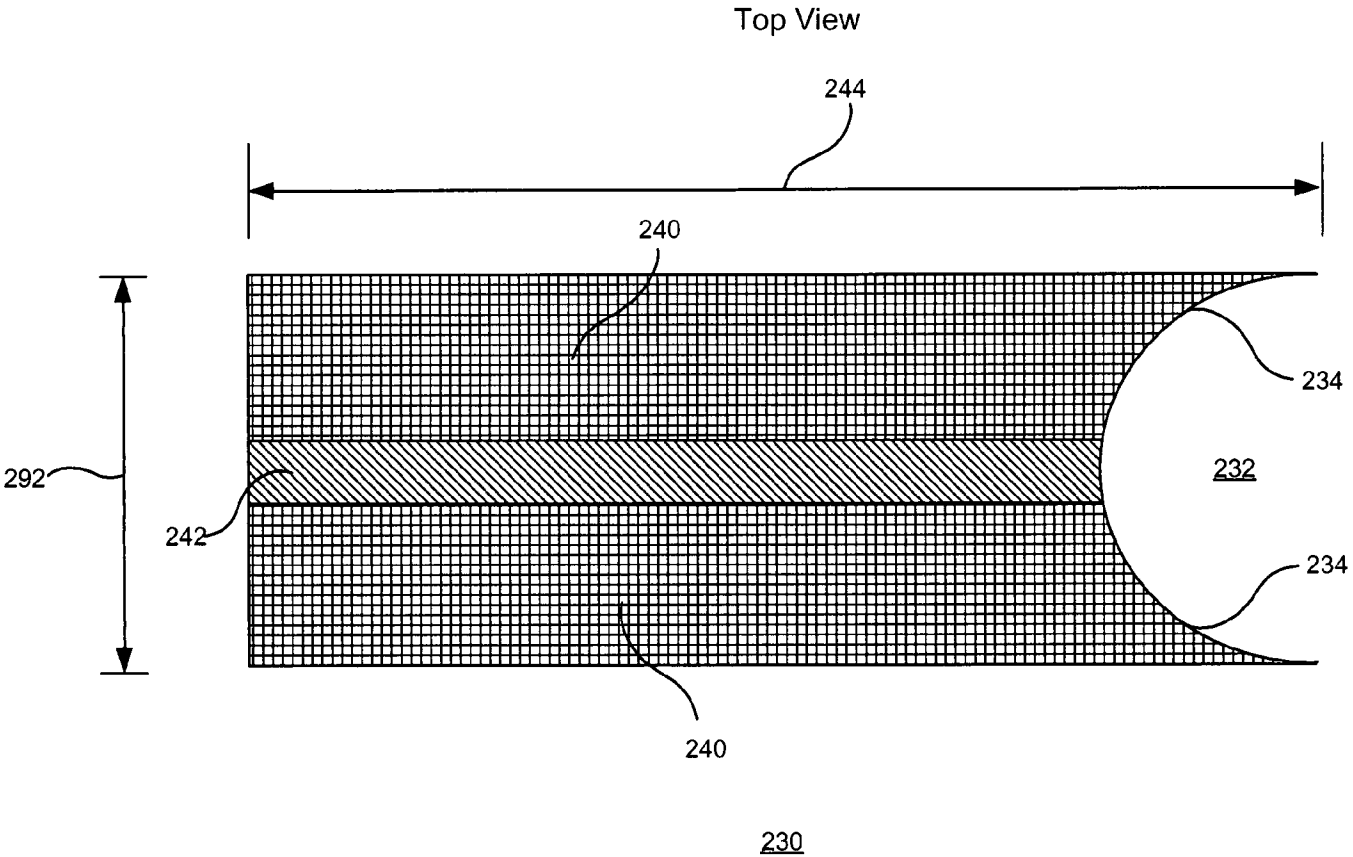
FIG. 2 is a top view of one embodiment of a component of a CTSA.

FIG. 2 is a top view of one embodiment of a CDL of CTSA 100. As shown in FIG. 2, CDL 230 has a semi-rectangular shape. CDL 230 of FIG. 2 is substantially similar to CDL 130 of FIGS. 1A–1C, and thus, similar components are not described again hereinbelow. CDL 230 includes inner top surface 242, outer top surface 240 and concave aperture 232, which is defined by concave curvature 234. CDL 230 has length 244 and width 292. Width 292 is greater than width 192 of CDL 130.

Figure 3:
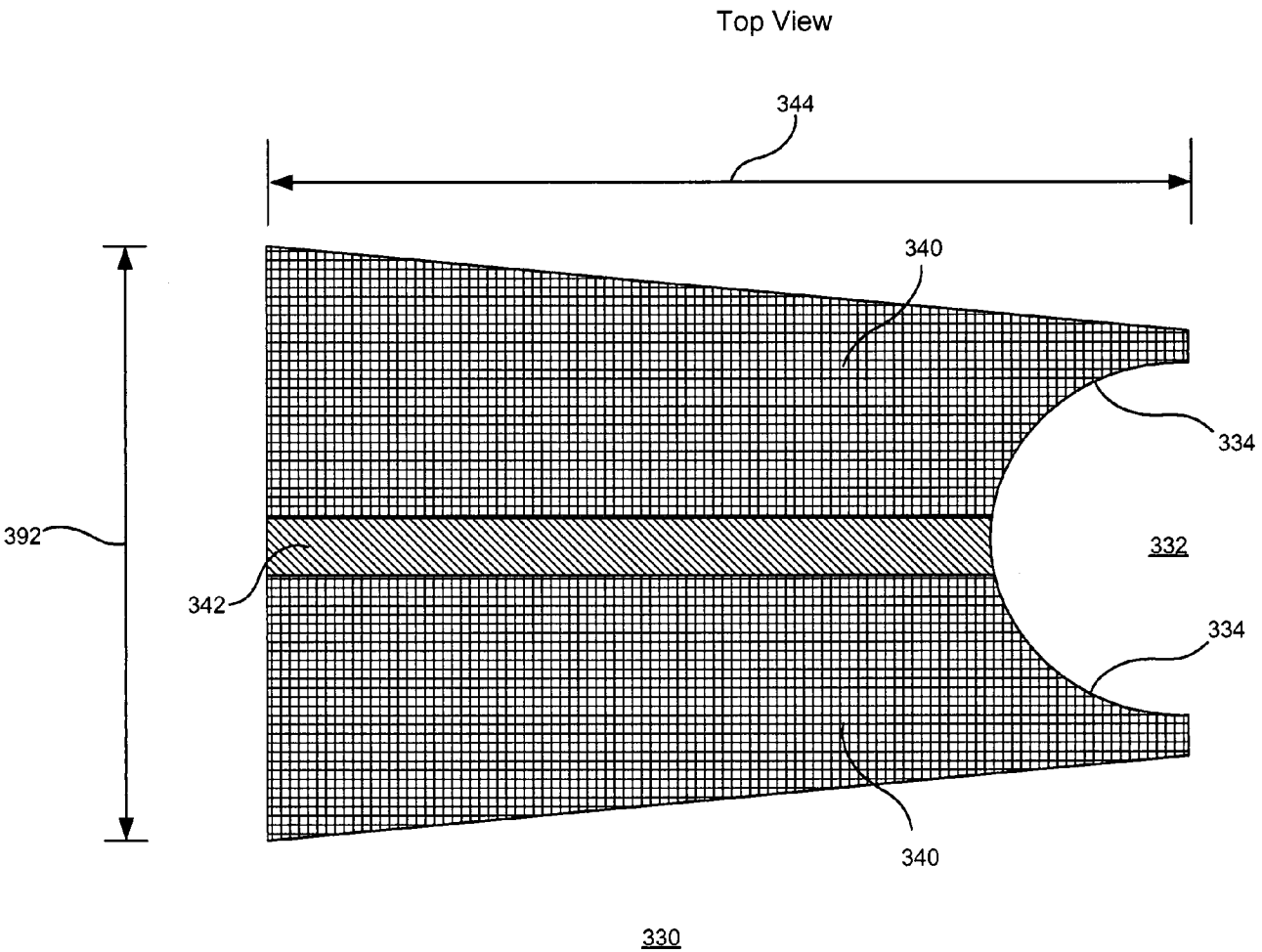
FIG. 3 is a top view of one embodiment of a component of a CTSA.

FIG. 3 is a top view of one embodiment of a CDL of CTSA 100. As shown in FIG. 3, CDL 330 has a semi-trapezoid shape. CDL 330 of FIG. 3 is substantially similar to CDL 130 of FIGS. 1A–1C, and thus, similar components are not described again hereinbelow. CDL 330 includes inner top surface 342, outer top surface 340 and concave aperture 332, which is defined by concave curvature 334. CDL 330 has length 344 and width 392. Width 392 is greater than width 192 of CDL 130.

Figure 4:
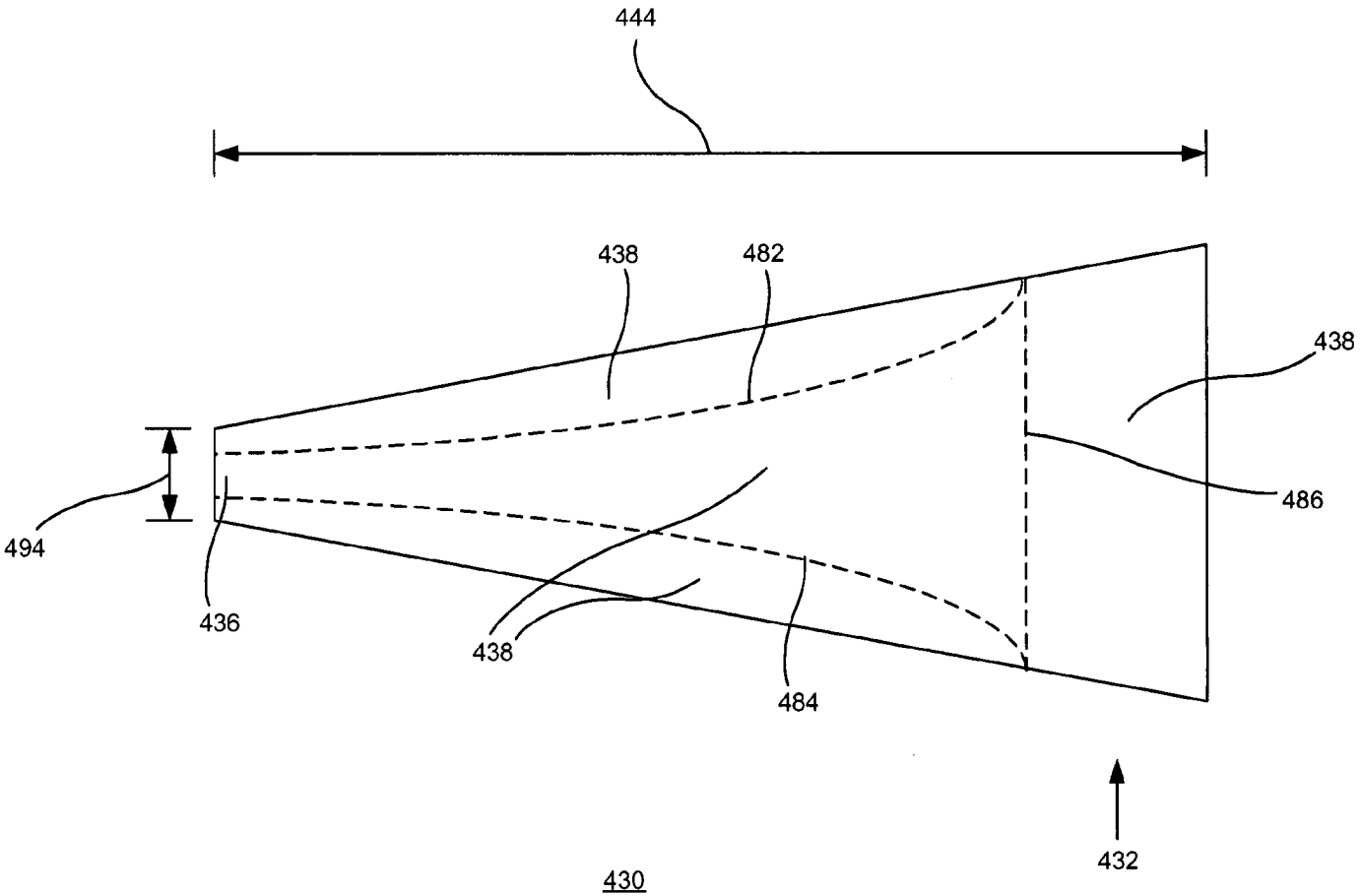
FIG. 4 is a side view of one embodiment of a component of a CTSA.

FIG. 4 is a side view of one embodiment of a CDL of CTSA 100. As shown in FIG. 4, CDL 430 has side surface 438, feed end 436 and concave aperture 432, which is defined by dashed line 486. Inner top and bottom surfaces are defined by dashed lines 482 and 484, respectively. CDL 430 has length 444 and height 494, which is greater than a gap height of CTSA 100.

Figure 5:
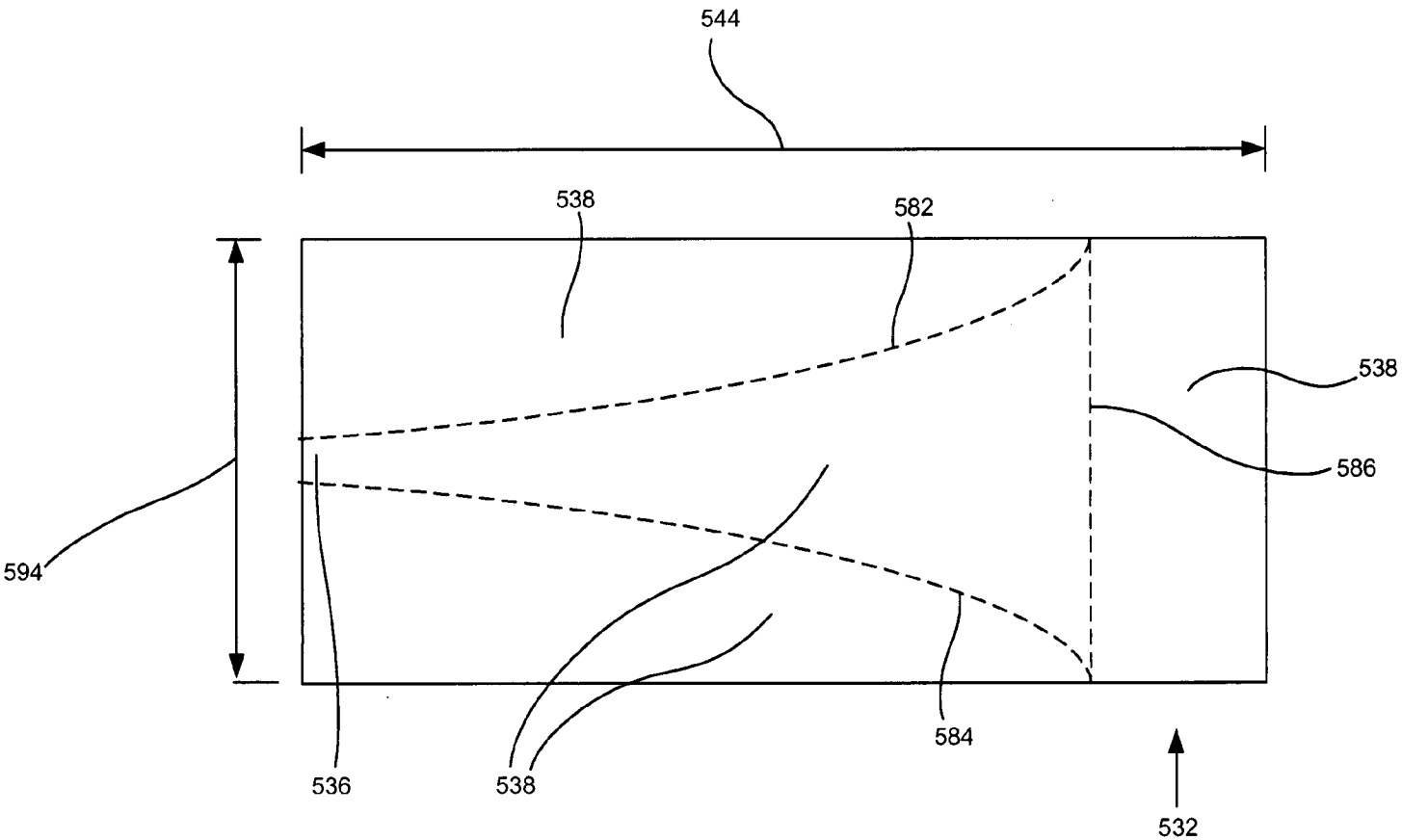
FIG. 5 is a side view of one embodiment of a component of a CTSA.

FIG. 5 is a side view of one embodiment of a CDL of CTSA 100. As shown in FIG. 5, CDL 530 has side surface 538, feed end 536 and concave aperture 532, which is defined by dashed line 586. Inner top and bottom surfaces are defined by dashed lines 582 and 584, respectively. CDL 530 has length 544 and height 594, which is greater than gap height 794 (FIGS. 7D and 7E).

Figure 6:
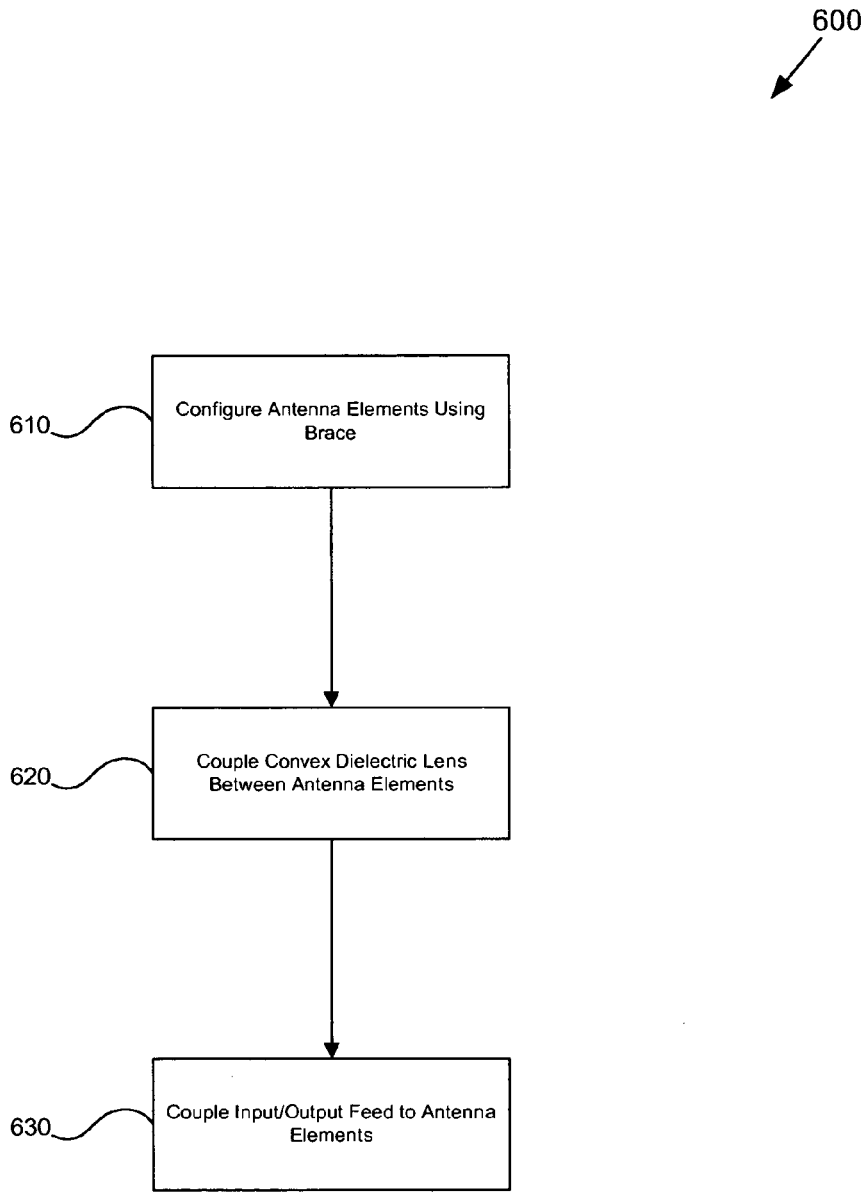
FIG. 6 is a flowchart of an exemplary method of manufacturing one embodiment of a CTSA.

FIG. 6 is a flowchart illustrating exemplary process steps taken to implement an exemplary CTSA. Certain details and features have been left out of flowchart 600 of FIG. 6 that are apparent to a person of ordinary skill in the art. For example, a step may consist of one or more sub-steps or may involve specialized equipment or materials, as known in the art. While STEPS 610 through 630 shown in flowchart 600 are sufficient to describe one embodiment of the CTSA, other embodiments of the CTSA may utilize steps different from those shown in flowchart 600.

FIGS. 7A–7E are views of some of the features of an exemplary CTSA in intermediate stages of fabrication, formed in accordance with one embodiment of the CTSA. These fabrication stages are described in detail below in relation to flowchart 600 of FIG. 6.

Figure 7B:
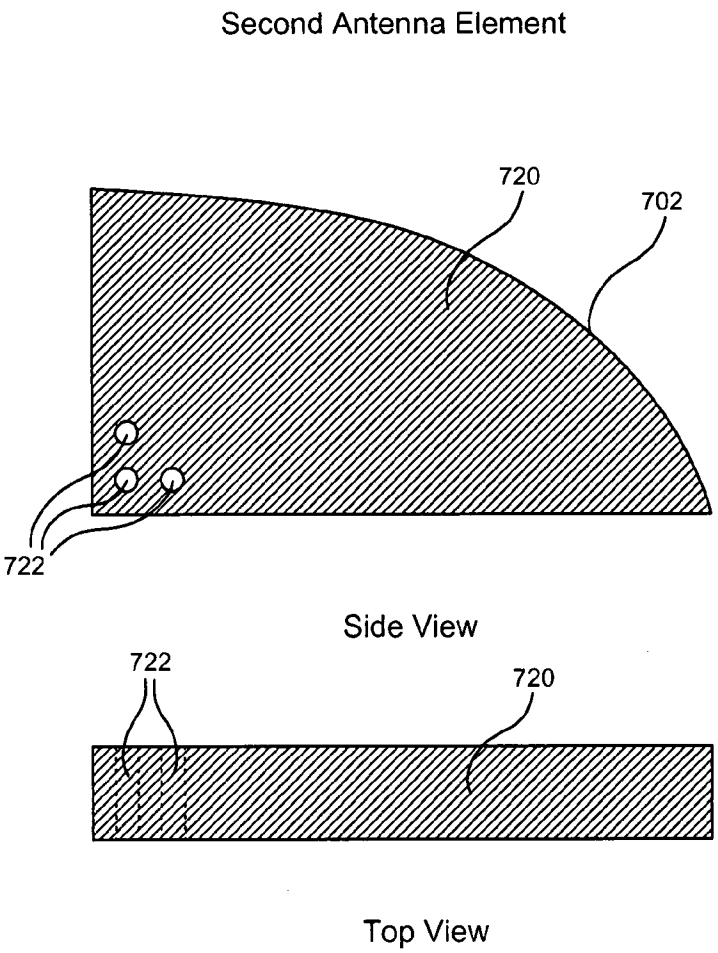
FIG. 7B is a side and top view of some of the features of an exemplary CTSA formed in accordance with one embodiment of a CTSA.
Figure 7A:
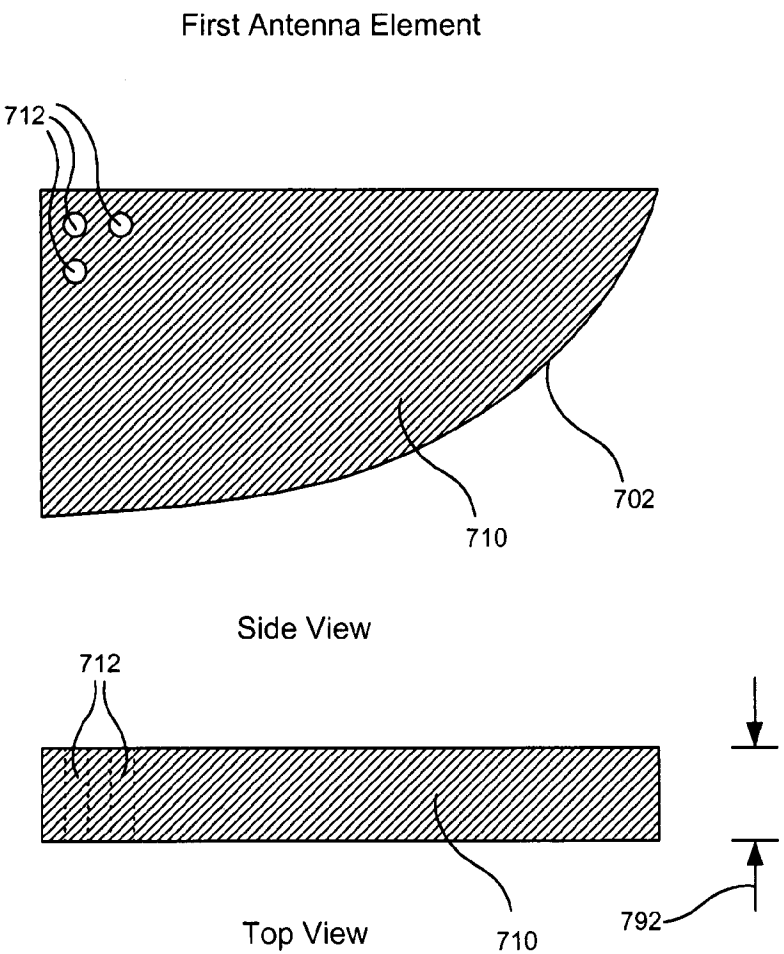
FIG. 7A is a side and top view of some of the features of an exemplary CTSA formed in accordance with one embodiment of a CTSA.
Figure 7C:
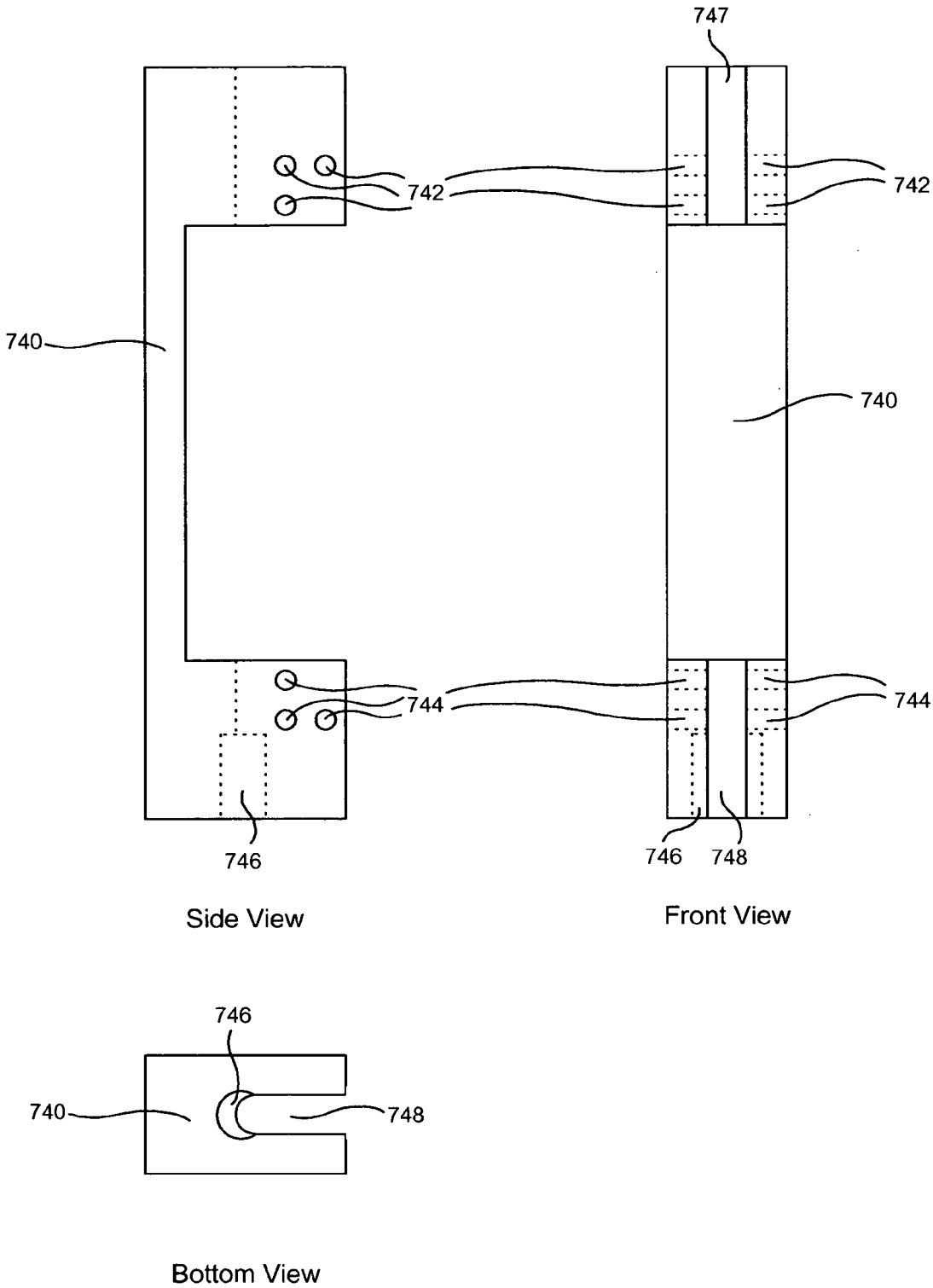
FIG. 7C is a side, front and bottom view of some of the features of an exemplary TSA formed in accordance with one embodiment of a CTSA.
Figure 7D:
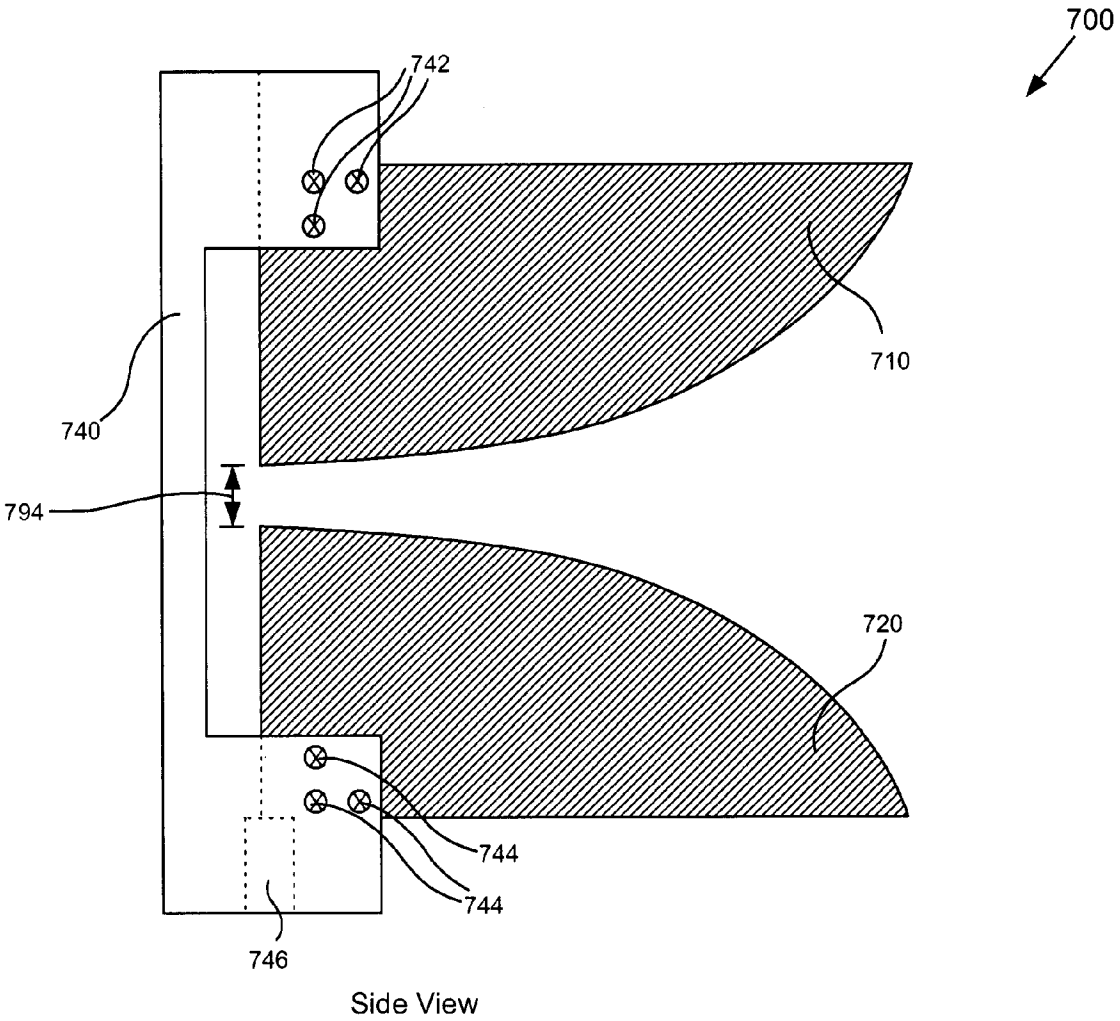
FIG. 7D is a side view of some of the features of an exemplary TSA formed in accordance with one embodiment of a CTSA.
Figure 7E:
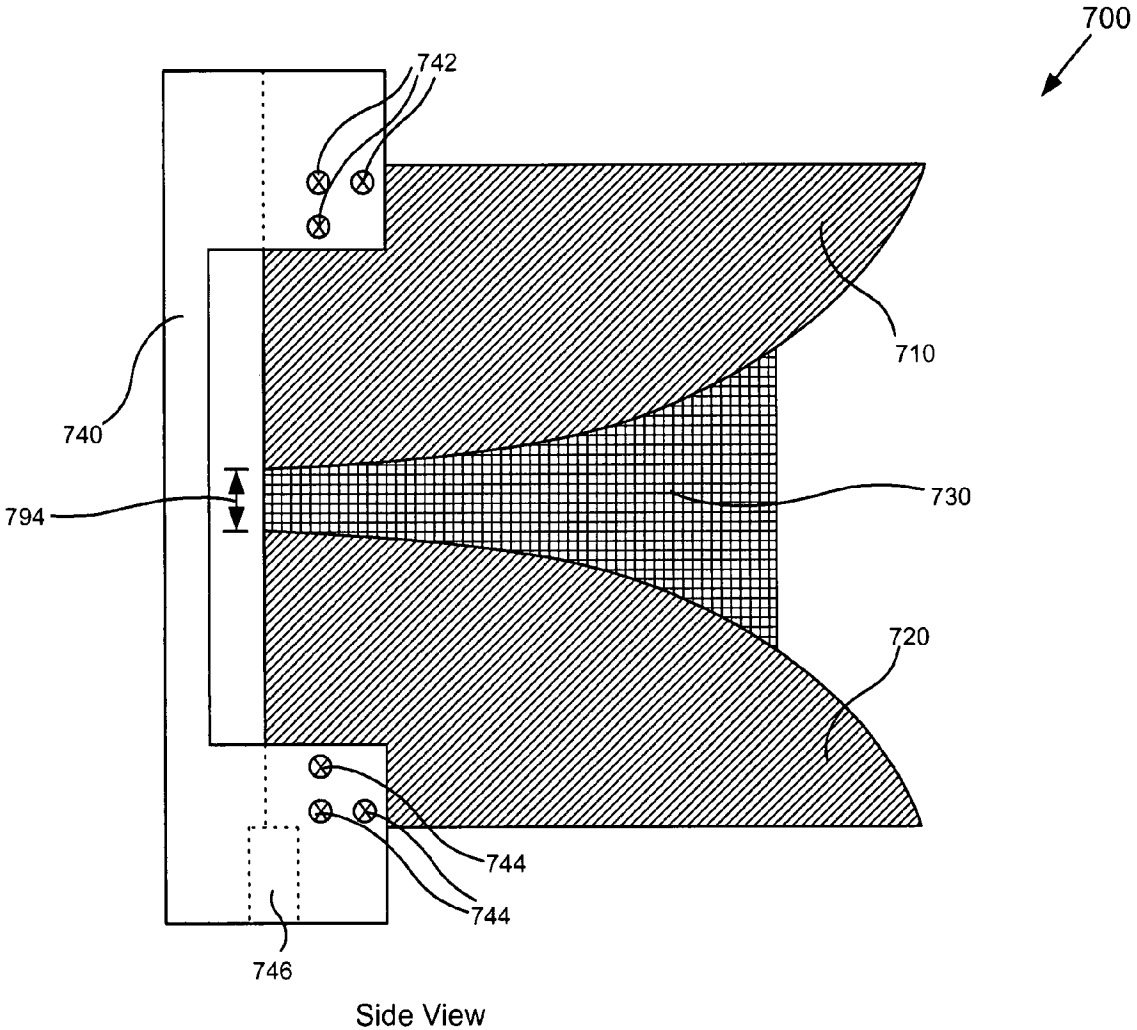
FIG. 7E is a side view of some of the features of an exemplary TSA formed in accordance with one embodiment of a CTSA.

Referring to FIGS. 6 and 7A–7E, at STEP 610 in flowchart 600, the method configures first antenna element 710 and second antenna element 720 using brace 740. First and second antenna elements 710, 720 comprise a substantially conductive material such as, for example, stainless steel and aluminum. First and second antenna elements 710, 720 are capable of transmitting and receiving radio frequency (rf) energy. FIG. 7A is a top and side view of one embodiment of first antenna element 710. As shown in FIG. 7A, first antenna element 710 includes apertures 712. In one embodiment, apertures 712 are threaded apertures. Apertures 712 are adapted to receive fasteners such as threaded screws and bolts. FIG. 7B is a top and side view of one embodiment of second antenna element 720. As shown in FIG. 7B, second antenna element 720 includes apertures 722. In one embodiment, apertures 722 are threaded apertures. Apertures 722 are adapted to receive fasteners such as threaded screws and bolts. First and second antenna elements 710, 720 have a thickness equal to gap width 792, which is the gap width of the CTSA as described in detail below with reference to FIG. 7D. First and second antenna elements 710, 720 have curvature 702. In one embodiment, curvature 702 can be represented by the above-referenced Equation 1.

FIG. 7C is a side, front and bottom view of one embodiment of brace 740. Brace 740 comprises a substantially nonconductive material such as, for example, plastic and G10. As shown in FIG. 7C, brace 740 includes slots 747, 748, apertures 742, 744 and receiver aperture 746. Slots 747, 748 are adapted to snugly receive first and second antenna elements 710, 720, respectively, in a tapered slot antenna configuration. Apertures 742, 744 are adapted to substantially align with apertures 712, 722, respectively, so that a fastener such as a threaded screw can operatively couple first and second antenna elements 710, 720 to brace 740. Apertures 742, 744 are adapted to decrease the width of slots 747, 748 when used in conjunction with fasteners such as nuts and bolts, and thus, first and second antenna elements 710, 720 can be securely coupled to brace 740 using slots 747, 748. In one embodiment, apertures 742, 744 are threaded apertures. Receiver aperture 746 is adapted to receive an I/O feed such as an outer jacket of a coaxial cable.

FIG. 7D is a side view of one embodiment of CTSA 700. As shown in FIG. 7D, first antenna element 710 is operatively coupled to brace 740 via fasteners (represented on FIG. 7D by the symbol "X") used in conjunction with apertures 742. Similarly, second antenna element 720 is operatively coupled to brace 740 via fasteners (represented on FIG. 7D by the symbol "X") used in conjunction with apertures 744. CTSA 700 has gap height 794. As previously described with reference to FIG. 7B, CTSA 700 has gap width 792, which approximately equals the thickness of either of first and second antenna elements 710, 720. Gap width 792 and gap height 794 are related in accordance to a simplified TSA input matching technique, which can be represented by the following Equation 2:

$$\frac{w}{h} = \frac{44\pi}{Z_0\sqrt{\varepsilon_r}}; \qquad \text{(Equation 2)}$$

where, w gap width h=gap height $Z_0$=characteristic impedance $\epsilon_r$=dielectric constant of dielectric spacing The simplified TSA input matching technique allows CTSA 700 to match a predetermined impedance (e.g., 50 Ohms) over a broad frequency band. Thus, CTSA 200 does not require a matching network. In one embodiment, gap width 792 is approximately equal to 0.375 inches and gap height 794 is approximately equal to 0.125 inches. In one embodiment, $e_r$ approximately equals approximately 2.2. After STEP 610, the method proceeds to STEP 620.

Referring to FIGS. 6 and 7E, at STEP 620 in flowchart 600, the method operatively couples concave dielectric lens 730 between first and second antenna elements 710, 720 so that a 3 dB beamwidth increases for selected frequencies. In one embodiment, CDL 730 has a concave curvature comprising a circular shape with respect to a vertical axis, which increases horizontal 3 dB beamwidth. In one embodiment, CDL 730 has a concave curvature comprising a circular shape with respect to a horizontal axis, which increases vertical 3 dB beamwidth. In one embodiment, CDL 730 has a concave curvature comprising a spherical shape, which increases horizontal and vertical 3 dB beamwidth. In one embodiment, CDL 730 has a concave curvature comprising an ellipsoid shape, which increases horizontal and vertical 3 dB beamwidth. FIG. 7E is a side view of one embodiment of CTSA 700. In one embodiment, CDL 730 is coupled to first and second antenna elements 710, 720 via a bonding agent such as epoxy or fiberglass pins. In one embodiment, CDL 730 is coupled between first and second antenna elements 710, 720 via mounting CDL 730 to brace 740. In one embodiment, CDL 730 is coupled between first and second antenna elements 710, 720 via coupling CDL 730 to brace 740 via a bonding agent or fiberglass pins. In one embodiment, CDL 730 is coupled between first and second antenna elements 710, 720 via coupling CDL 730 to brace 740 via a substantially non-conductive mounting bracket.

Referring to FIG. 6, at STEP 620 in flowchart 600, the method couples an I/O feed to first and second antenna elements 710, 720. In one embodiment, the method operatively couples a semi-infinite balun (SIB) to first and second antenna elements 710, 720 using receiver aperture 746. In one embodiment, the SIB is a coaxial cable that could have a SMA or N-type connector. Those skilled in the art shall recognize that input feeds other than coaxial cable can be used as a semi-infinite balun without departing from the scope or spirit of the CTSA. For example, input feeds can comprise coupled stripline transformer and matching network feeds.

From the above description of the invention, it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

We claim:

1. A concave tapered slot antenna, comprising:

a) a first antenna element capable of transmitting and receiving rf energy;

b) a second antenna element capable of transmitting and receiving rf energy, wherein said first and second antenna elements are situated in a tapered slot antenna configuration;

c) a concave dielectric lens, wherein said concave dielectric lens is situated between said first and second antenna elements so that a 3 dB beamwidth for selected frequencies is increased, and wherein said concave dielectric lens has a concave aperture comprising a shape selected from the group consisting of circular, spherical and ellipsoid.

2. The concave tapered slot antenna of claim 1, wherein said concave dielectric lens has a concave aperture adapted to increase horizontal 3 dB beamwidth.

3. The concave tapered slot antenna of claim 1, wherein said concave dielectric lens has a concave aperture adapted to increase vertical 3 dB beamwidth.

4. The concave tapered slot antenna of claim 1, wherein said concave dielectric lens has a concave aperture adapted to increase horizontal and vertical 3 dB beamwidth.

5. The concave tapered slot antenna of claim 1, wherein said concave tapered slot antenna further comprises a brace operatively coupled to said first and second antenna elements, wherein said brace situates said first antenna element and said second antenna element in a tapered slot antenna configuration.

6. The concave tapered slot antenna of claim 1, wherein said concave tapered slot antenna further comprises an I/O feed, operatively coupled to said first antenna element and said second antenna element, capable of transmitting and receiving rf signals.

7. The concave tapered slot antenna of claim 1, wherein a side surface of said concave dielectric lens comprises a shape selected from the group consisting of rectangular, trapezoidal and curvilinear trapezoidal.

8. The concave tapered slot antenna of claim 1, wherein said concave dielectric lens comprises a substantially dielectric material.

9. A method for a concave tapered slot antenna, the method comprising the steps of:

a) configuring a first antenna element and a second antenna element in a TSA configuration using a brace;

b) coupling a concave dielectric lens having a concave aperture comprising a shape selected from the group consisting of circular, spherical and ellipsoid between said first and second antenna elements so that a 3 dB beamwidth increases for selected frequencies.

10. The method of claim 9, wherein said coupling said concave dielectric lens STEP (b) comprises the following sub-steps:

i) forming said concave dielectric lens having a concave aperture adapted to increase a 3 dB beamwidth;

ii) coupling said concave dielectric lens between said first and second antenna elements so that a 3 dB beamwidth increases for selected frequencies.

11. The method of claim 9, wherein said coupling said concave dielectric lens STEP (b) comprises the following sub-steps:

i) coupling a concave dielectric lens between said first and second antenna elements so that a 3 dB beamwidth increases for selected frequencies;

ii) coupling an I/O feed to said first antenna element and said second antenna element.

12. The method of claim 9, wherein said I/O feed is a SIB.

13. The method of claim 9, wherein said coupling said concave dielectric lens STEP (b) comprises coupling said concave dielectric lens between said first and second antenna elements using a bonding agent.

14. The method of claim 13, wherein said bonding agent comprises fiberglass pins.

15. The method of claim 9, wherein said coupling said concave dielectric lens STEP (b) comprises coupling said concave dielectric lens between said first and second antenna elements by mounting said concave dielectric lens to said brace.

16. A concave tapered slot antenna, comprising:

a) means for configuring a first antenna element and a second antenna element in a TSA configuration using a brace;

b) means, operatively coupled and responsive to said means for configuring a first antenna element and a second antenna element, for coupling a concave dielectric lens having a concave aperture comprising a shape selected from the group consisting of circular, spherical and ellipsoid between said first and second antenna elements so that a 3 dB beamwidth increases for selected frequencies.

17. The concave tapered slot antenna of claim 16, wherein said means for coupling a concave dielectric lens comprises:

i) means for coupling a concave dielectric lens between said first and second antenna elements so that a 3 dB beamwidth increases for selected frequencies;

ii) means, operatively coupled and responsive to said means for coupling a concave dielectric lens, for coupling an I/O feed to said first antenna element and said second antenna element.

* * * * *